US005934968A

United States Patent [19]

Lin

[11] Patent Number: 5,934,968

[45] Date of Patent: Aug. 10, 1999

[54] RANDOM MOVING TOY SIMULATING PURSUIT BY TOY ANIMAL

[75] Inventor: Li-Hsiang Lin, Taipei, Taiwan

[73] Assignee: Dah Yang Toy Industrial Co., Ltd., Taipei, Taiwan

[21] Appl. No.: 08/862,067

[22] Filed: May 22, 1997

Related U.S. Application Data

[63] Continuation of application No. 08/573,514, Dec. 15, 1995, abandoned.

[51] Int. Cl.[6] ..... A63H 11/02

[52] U.S. Cl. ..... 446/358; 446/431; 446/437; 473/595

[58] Field of Search ..... 446/269, 278, 446/279, 286, 324, 431, 437, 448, 352, 358, 368; 273/58 C; 473/594, 595

[56] References Cited

U.S. PATENT DOCUMENTS

| | | | |
|---|---|---|---|
| 672,707 | 4/1901 | Mackin et al. | 446/274 |
| 800,741 | 10/1905 | Howard | 446/269 |
| 3,990,176 | 11/1976 | Puschkarski | 446/368 |
| 4,088,319 | 5/1978 | Clarke . | |
| 4,203,251 | 5/1980 | Malek et al. | 446/236 |
| 4,471,565 | 9/1984 | Terzian | 446/273 |
| 4,708,690 | 11/1987 | Kulesza | 446/236 |
| 5,228,690 | 7/1993 | Rudell et al. . | |
| 5,236,383 | 8/1993 | Connelly | 446/219 |
| 5,265,559 | 11/1993 | Borell | 119/707 |
| 5,297,981 | 3/1994 | Maxim et al. | 446/437 |
| 5,398,928 | 3/1995 | Rudell et al. . | |
| 5,727,984 | 3/1998 | Lin | 473/576 |

FOREIGN PATENT DOCUMENTS 75200123 1/1986 Taiwan .

OTHER PUBLICATIONS

Letter from Anthony O. Cormier dated Jan. 27, 1997 with attachments.
Response letter to Anthony O. Cormier dated Jan. 31, 1997.
Brochure for Global Fun toy (at least as early as 1988).
Copy of Instruction Sheet and brochure for Cat Trap toy (at least as early as 1995).
Photograph of Crazy Critter toy and copy of package (at least as early as 1995, 1996).
Copy of brochures for Squiggle Ball toy (at least as early as 1993).
Copy of Brochures for Motor Balls™ toys (at least as early as 1995, 1996).
Brochure for rabbit fur keychains from Full Chau Enterprise Development (HK) Co.
Wild Tail Pet Toy; http://alpha–omega.net/guide/board40/messages/29.htm.
Wilt Tail Toy For Pets; http://www.videohouse.com/wildtail.

*Primary Examiner*—Robert A. Hafer
*Assistant Examiner*—Jeffrey D. Carlson
*Attorney, Agent, or Firm*—Darby & Darby

[57] ABSTRACT

A toy having a motorized portion in the form of an inanimate object and a non-motorized portion in the form of an animate object. The two portions are tethered together, and the motorized portion is driven such that the non-motorized portion in the form of an animate object appears to be alive and in pursuit of the inanimate motorized portion. The motorized portion preferably is in the form of a substantially spherical hollow ball within which an eccentric driving mechanism is placed. The non-motorized portion is an animal with a furry body or bushy tail and is preferably a weasel, embodies by a furry tail having a face invisibly connected to the ball. The non-motorized portion is preferably tethered to the motorized portion with a substantially invisible attachment so that from a distance the two portions of the toy do not appear to be connected together.

42 Claims, 3 Drawing Sheets

RANDOM MOVING TOY SIMULATING PURSUIT BY TOY ANIMAL

This is a continuation of application Ser. No. 08/573,514, filed Dec. 15, 1995 now abandoned.

BACKGROUND OF THE INVENTION

The present invention relates to a toy having a motorized portion to which a non-motorized toy is attached to give the appearance of chasing the motorized portion. More particularly, the present invention relates to a hollow sphere containing a driving mechanism to cause the sphere to roll eccentrically. A flexible, non-motorized toy is attached to the sphere via a flexible line and chases and rolls with the sphere so that the non-motorized toy appears to be a live animal that is pushing the sphere to propel it.

Motorized, self-propelling toys are known in the art. The driving unit of such toys is commonly positioned within the toy to cause the toy to move eccentrically. For example, weighted pendulums have been used to alter the movement of motorized spherical devices. Alternatively, motors have been placed off center from the axis of a spherical toy to offset the center of gravity of the driving mechanism, and thereby cause the spherical toy to move eccentrically. Additionally, weights have been used that are offset from the axis of a spherical toy to cause eccentric movement. Combinations of such driving means have also been used. Others hollow toys include a track positioned within the toy and driving mechanism that moves along the track and thereby propels the toy.

Internally motorized toys to which non-motorized objects are externally attached are also known in the art. The non-motorized object is attached to the motorized toy such that the non-motorized object moves with and is affected by the movement of the toy. Generally, the toy moves in a relatively stable path so that the attached toy mimics a crawling or rolling animal. The motorized portion of the toy typically is integrated with the animal-like portion so that there is no great distinction between the two portions of the toy.

SUMMARY OF THE INVENTION

The principal object of the present invention is to provide a motorized toy having a motorized portion and a soft flexible animal-like attachment. The motorized portion has a movement which pulls the animal-like attachment (which appears to be alive and to chase and jump in pursuit of the motorized portion) along after it.

A related object of the present invention is to provide a substantially spherical hollow toy in which a driving mechanism is positioned to cause the spherical toy to move in an eccentric path, the toy having attached thereto a separate, flexible toy moveably connected to the exterior of the spherical motorized toy. In operation, the arrangement simulates a pursuit, the flexible toy appearing to be chasing the spherical toy.

A further related object of the present invention is to provide a self-propelled motorized rolling ball to which an animal-like flexible toy is invisibly attached, so that the ball and animal-like toy appear to be two separate toys and the animal-like toy appears to propel the ball rather than be propelled by the ball, the ball thus appearing to be propelled by the animal instead of a motor.

These and other objects of the invention are accomplished in accordance with the principles of the present invention by providing a motorized ball and a soft, flexible, unmotorized toy invisibly attached to the ball. The ball is preferably formed from two hollow hemispherical portions in which a motor is rotatably fixed. The internal driving mechanism of the ball is designed to cause the ball to roll in an eccentric path. The non-motorized toy is connected to an external portion of the ball with a preferably invisible connection that permits the non-motorized portion of the toy to move, even at its connection point, with respect to the motorized portion of the toy.

These and other objects, features, and advantages of the present invention will be readily apparent from the following detailed description of the invention taken in conjunction with the accompanying drawings wherein like reference characters represent like elements, the scope of the invention being set out in the appended claims.

DETAILED DESCRIPTION OF THE INVENTION

Figure 1:
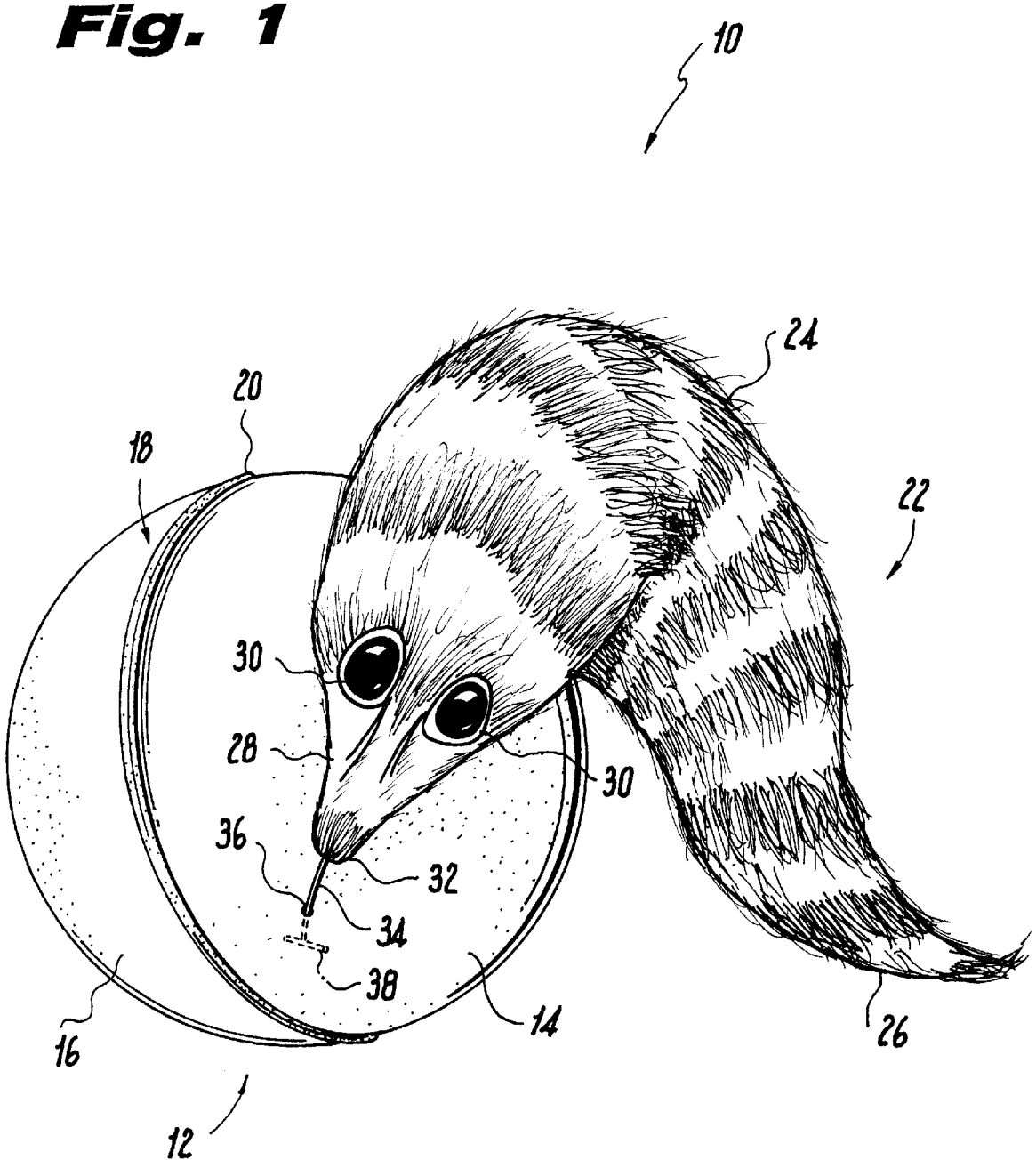
FIG. 1 is an isometric view of a toy having a motorized ball and a non-motorized animal-like attachment in accordance with the principles of the present invention.

A toy 10 that is capable of random motion and which is chased by an animal-like non-motorized toy, disclosed in accordance with the principles of the present invention, is shown in FIG. 1. Toy 10 includes a motorized portion 12, in the form of an inanimate object such as a substantially spherical ball. Preferably ball 12 is formed from first and second hemispherical sections 14 and 16 joined and separable along equator 18. For example, hemispherical sections 14 and 16 may be screwed together or otherwise detachably connected along equator 18. Ring 20, which may be a rubber O-ring or a metal ring, may be positioned along equator 18 for ornamental purposes, and also to demarcate hemispherical sections 14 and 16 along equator 18 (to identify the line along which hemispherical sections 14 and 16 may be separated). Toy 10 also includes a non-motorized portion which is preferably flexible and embodied in the form of an animal 22 or other animate object. Animal 22 preferably includes a body portion 24 having a tail 26 preferably positioned distally from motorized portion 12, and a face 28 preferably positioned proximal to motorized portion 12. Face 28 may include facial features such as eyes 30 and nose 32. As shown in FIG. 1, the animal-like non-motorized toy 22 is in the form of a weasel. The flexible toy 22 can also be made to resemble other animals including, by way of non-limiting example, a squirrel, raccoon, cat, dog, mouse, lion, tiger, etc. Non-motorized toy 22 is preferably formed from a flexible, soft, furry material that moves easily with, and can roll around with ball 12. As shown, weasel 22 is connected to one of hemispherical portions 14, 16 of ball 12 at a position adjacent but slightly spaced from equator 18 of ball 12 and thus not directly on equator 18. However, it will be appreciated that weasel 22 can be connected to either hemispherical portion 14, 16 at any other desired location. Weasel 22 is preferably connected at its nose 32 with an attachment 34 that preferably slightly spaces weasel 22 from ball 12. In a preferred embodiment, attachment 34 is threaded through a hole 36 in one of hemispherical portions 14 and 16 of ball 12 such that attachment 34 may rotate with respect to ball 12, and also may move into and out of ball 12 along the length of attachment 34 between nose 32 of weasel 22 and perpendicular stop 38 of attachment 34. Perpendicular stop 38 thereby prevents attachment 34, with weasel 22, from becoming detached from ball 12. In accordance with the principles of the present invention, attachment 34 is a substantially invisible tether such as a clear nylon or plastic thread. Thus, from a distance, weasel 22 does not appear to be connected to ball 12.

Ball 12 has a motorized driving mechanism and is self-propelled. Thus ball 12 can roll along a surface on which it is placed. In operation, weasel 22, attached with a preferably invisible attachment 34, appears to chase after ball 12. For added interest, ball 12 is preferably provided with a driving mechanism 40 that is eccentrically positioned within ball 12 to cause ball 12 to move randomly along a surface with an eccentric irregular motion and thereby also vary the relative motion of weasel 22 with respect to ball 12. A preferred driving mechanism 40 is shown in FIGS. 2–4.

Figure 2:
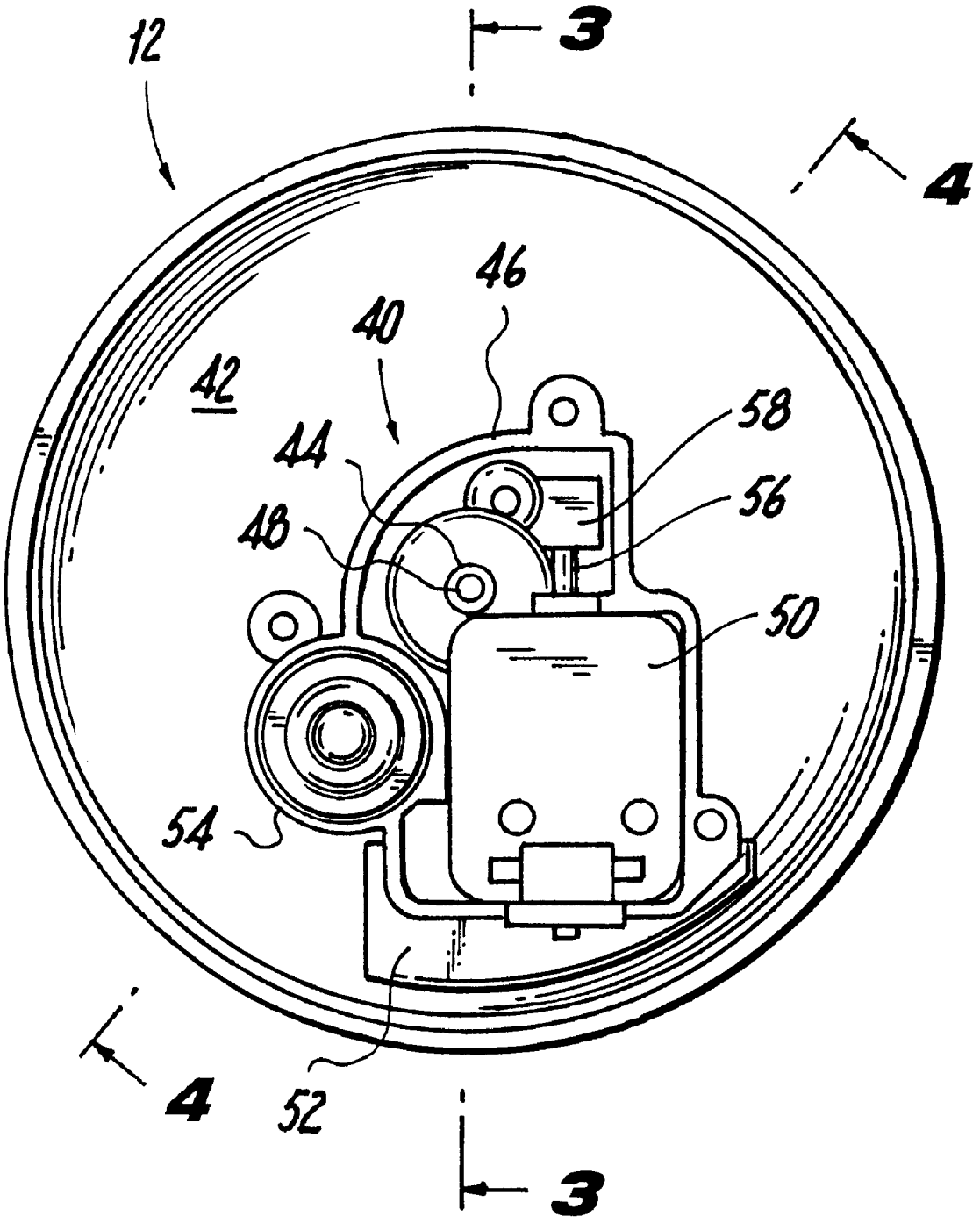
FIG. 2 is a cross-sectional view of the motorized ball of the present invention, taken in an axial direction.
Figure 4:
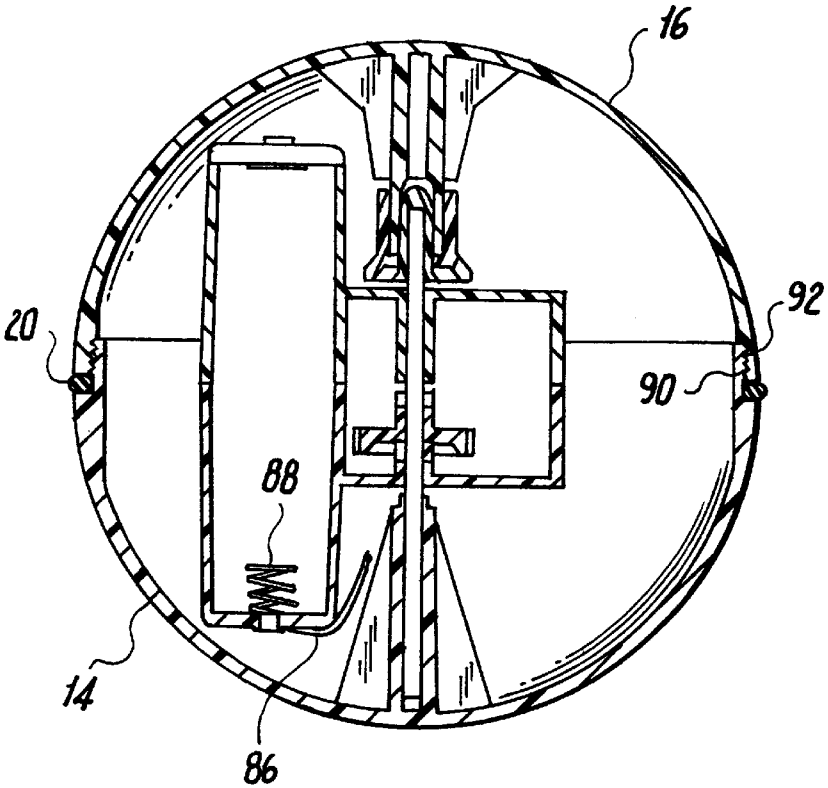
FIG. 4 is a cross-sectional view of the motorized ball of the present invention, similar to that of FIG. 3, but along line 4—4 of FIG. 2 and a different plane through the axis of the driving mechanism.
Figure 3:
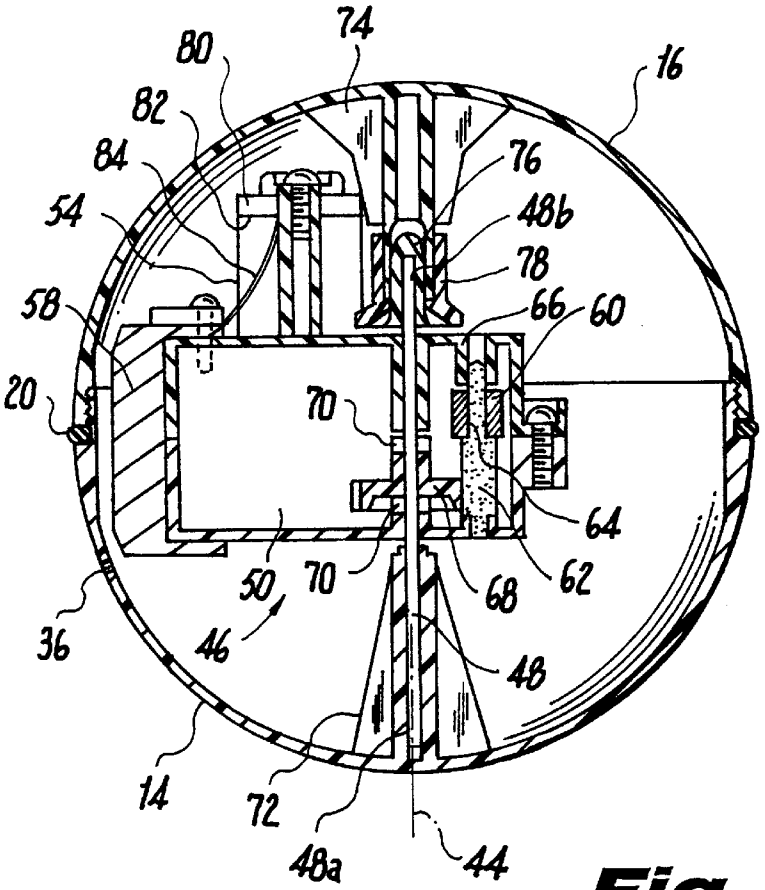
FIG. 3 is a cross-sectional view, along line 3—3 of FIG. 2, of the motorized ball of the present invention, taken along and perpendicular to the axis of rotation of the driving mechanism.

Motorized portion or ball 12 is preferably substantially hollow, having an internal cavity 42 in which driving mechanism 40 is positioned, as shown in FIGS. 2–4. A cross-section of ball 12 showing a plan view of driving mechanism 40, and substantially perpendicularly cutting across a rotational axis 44 of driving mechanism 40, is shown in FIG. 2. Driving mechanism 40 preferably has a housing 46 in which the elements of driving mechanism 40 are housed. Housing 46 is rotatably mounted about axis 44 along axle pin 48 which is preferably formed from a rigid, sturdy material such as stainless steel. Driving mechanism 40 has a motor 50 positioned within housing 46. The motor 50 is preferably positioned off-center and away from the central rotational axis 44, such as shown in FIGS. 2 and 3. This off-center position allows motor 50 to rotate about axis 44, as will be described in greater detail below, and thereby cyclically shift the center of gravity of ball 12. The cyclic shift of the center of gravity of ball 12 causes ball 12 to roll in a random, eccentric pattern or path. If desired, weight 52 may be provided on housing 46 to further enhance the effects of the off-centered motor 50 in causing the internal center of gravity to shift and the consequent eccentric movement of ball 12. Motor 50 is preferably energized by a battery that is positioned within battery casing 54 of housing 46.

The manner in which motor 50 causes housing 46 to rotate about axis 44 and thereby randomly propel ball 12 along a surface is more easily understood with reference to both FIG. 2 and FIG. 3, a cross-section along line 3—3 of FIG. 2.

Motor 50 has a driving axle 56 on which worm gear 58 is fixedly positioned (FIG. 2). Worm gear 58 of motor 50 drives pinion 60 (FIG. 3), which is preferably a ten-tooth pinion. Pinion 60 is fixed with respect to pinion 62 (preferably a six-tooth pinion) about an axial extension 64 of pinion 62. Pinion 62 is preferably rotatably mounted within a gear box portion 66 of housing 46, thereby permitting rotation of both pinion 62 and pinion 60. Pinion 62, which is driven by pinion 60, engages and drives gear 68 (preferably a twenty-fix-tooth gear). Gear 68 is fixedly positioned on pin 48 via sleeve 70. Hemispherical portions 14 and 16 are preferably provided with respective mounting sleeves 72 and 74 which hold the free ends of pin 48. A first end 48*a* of pin 48 is preferably fixed within mounting sleeve 72 so that when ball 12 is opened, housing 46, which is rotatably mounted on pin 48, remains connected to hemispherical portion 14. It is noted that hemispherical portion 14 also includes hole 36 for attachment of weasel 22, but it will be understood that hole 36 may be provided in the other hemispherical portion 16 instead. Hole 36 can be positioned anywhere in either hemispherical portion 14 or 16. Cap 76 is preferably fixed to the second end 48*b* of pin 48 and is inserted within mounting sleeve 74 when ball 12 is closed. Preferably, a sleeve 78 is positioned on mounting sleeve 74 to facilitate insertion of cap 76 and second end 48*b* of pin 48 within mounting sleeve 74.

Thus, in accordance with the principles of the present invention, motor 50 causes driving mechanism 40 to move ball 12 as follows. Driving axle 56 of motor 50 rotates worm gear 58 which is fixedly attached thereon. Worm gear 58 drives pinion 60 which is fixedly attached to and therefore drives pinion 62. Pinion 62 engages gear 68, which is fixedly mounted on pin 48, and thus rotates about gear 68. Pin 48 is fixed to at least one of hemispherical portions 14, 16 of ball 12. Actuation of motor 50 thus causes housing 46 of driving mechanism 40 to be driven about gear 68 on pin 48 via gear box 66. Because motor 50 is radially displaced from the axis of rotation 44 of the driving mechanism 40, and also because of the added weight 52, actuation of driving mechanism 40 (which causes rotation of housing 46) causes ball 12 to move in an eccentric, random path.

As described above, motor 50 employs a small direct current power source and is preferably powered by a battery positioned within battery casing 54 of housing 46. Battery casing 54 and the electrical connection of driving mechanism 40 provide motor 50 with power from a battery, as may be most easily understood with reference to FIGS. 3 and 4. Battery casing 54 preferably has a moveable battery case cover 80 within which an electrical contact 82 is positioned. Cover 80 is preferably pivotally or otherwise moveably mounted on housing 46 so that cover 80 functions as a switch to close the circuit of driving mechanism 40 to thereby provide power from a battery in battery casing 54 to motor 50. The switch formed by cap 80 and electrical contact 82 is electrically connected to motor 50 via wire 84. A second wire 86 (FIG. 4) is provided to electrically connect the other end of a battery (positioned within casing 54) to motor 50. Spring 88 within battery casing 54 functions as the other electrical contact for a battery that is positioned within battery casing 54, and is electrically connected to wire 86. In the driving mechanism 40 of FIGS. 2–4, the switch formed by battery cover 80 and electric contact 82 is accessed by separating hemispherical portions 14 and 16 to expose internal cavity 42. Hemispherical portions 14 and 16 may be rejoined, for example, along respective threads 90, 92.

Once driving mechanism 40 is actuated, motor 50 drives worm 54, pinion 60, pinion 62, and gear 68 to rotate housing 46 about axis 44 on pin 48. Because motor 50 is off-set from axis 44, and also because of added weight 52, rotation of housing 46 about axis 44 imparts an eccentric, wobbling motion to ball 12 to thereby cause ball 12 to move in an eccentric, random path or pattern. Animal-like toy 22, which, as shown in FIG. 1 as a weasel, is preferably connected to ball 12 in such a manner that weasel 22 not only has relatively free motion with respect to ball 12 (except in a direction to become completely detached from ball 12), but also is not noticeably attached to ball 12. Thus, weasel 22 appears to chase and jump after ball 12 in the random path that ball 12 takes. Depending on the motion of ball 12, weasel 22 moves in a variety of directions with respect to ball 12, chasing after, and rolling around and with ball 12.

It will be appreciated that motorized portion 12 may taken on any other desired shape or form other than a spherical ball, so long as motorized portion 12 can move relatively freely along a surface on which it is placed. It will further be appreciated that non-motorized portion 22 may take on any other shape or form than a weasel such as shown. However, it is preferable that non-motorized portion 22 be relatively flexible so that non-motorized portion 22 may easily follow and roll with motorized portion 12. It is further preferable that non-motorized portion 22 resemble a living creature to create the effect that a living creature or animate object, which is not motorized, is chasing after an inanimate object. Although the inanimate object is the portion of the toy which is motorized, because the non-motorized portion takes on the shape of a living creature, the motorized portion does not seem to be motorized, but instead appears to be propelled by the non-motorized animate object.

Thus, although the present invention is described with respect to a ball being chased by a toy simulating a weasel, it will be understood that the principles of that the present invention may be used to form any type of toy having a non-motorized portion that appears animated and propels a motorized portion such that the motorization of the device is not obvious. Moreover, it will be understood that any other type of driving mechanism may be used that will impart the desired motion to the motorized portion of the toy such that the non-motorized portion appears to be the portion that causes the motion of the toy. From the foregoing description, ti will be clear that the present invention may be embodies in other specific forms, structures, arrangements, proportion, and with other elements, materials, and components, without departing from the spirit or essential characteristics of the present invention. The presently disclosed embodiment is therefore to be considered in all respects as illustrative and not restrictive, the scope of the invention being indicated by the appended claims, and not limited to the foregoing description.

What is claimed is:

1. A toy comprising:

a shell having a smooth exterior surface and an internal cavity;

a driving mechanism within said internal cavity, said driving mechanism adapted to impart an eccentric motion to said shell; and a flexible element spaced apart from said shell, said element having a head portion connected to said shell by a flexible tether such that the entirety of said flexible element can move freely around said attachment point in three dimensions wherein the tether is attached to said shell through an aperture in said surface of said shell, and a portion of said tether is movable into and out of said aperture.

2. A toy as in claim 1, wherein said shell comprises two substantially hemispherical shells joined and separable along an equator to permit easy access to said internal cavity.

3. A toy as in claim 2, further comprising a ring positioned between said two substantially hemispherical shells.

4. A toy as in claim 2, wherein the tether is attached adjacent to, but spaced apart from, said equator.

5. A toy as in claim 1, wherein said shell is substantially spherical.

6. A toy as in claim 1, wherein said flexible element is in the form of an animal.

7. A toy as in claim 1, wherein:

said shell is substantially spherical and further comprises a longitudinal axis; and said driving mechanism further comprises a motor positioned off-center from said longitudinal axis.

8. A toy as in claim 7, wherein said driving mechanism further comprises a housing rotatable about said longitudinal axis, and a weight on said housing to cause said driving mechanism to impart the eccentric motion to said substantially spherical shell.

9. A toy as in claim 7, said driving mechanism further comprising:

a housing, said motor being positioned within said housing;

a gear box within said housing;

a worm gear fixed to and driven by said motor;

a first pinion positioned within said gear box, and driven by said worm gear;

a second pinion rotatable with said first pinion;

a pin fixed to said substantially spherical shell along said longitudinal axis; and a gear fixed to said pin;

wherein said worm gear, driven by said motor, drives said first and second pinions along said gear to rotate said housing about said longitudinal axis.

10. A toy as in claim 1, wherein said tether is substantially invisible.

11. A toy as in claim 10, wherein said tether is clear.

12. A toy as in claim 1 wherein said non-motorized flexible element is tethered with only one tether to said shell.

13. A toy as in claim 1, further comprising a switch for actuating said driving mechanism.

14. A random motion toy comprising:

a substantially spherical motorized element having an internal driving mechanism adapted to impart an eccentric motion to said motorized element; and a flexible, non-motorized element having a head portion connected to said motorized element by a flexible tether at an attachment point such that the entirety of said flexible, non-motorized element is freely movable around said attachment point in three dimensions, said non-motorized element spaced apart from said motorized element, said tether attached to said motorized element through an aperture in said motorized element, a portion of said tether being movable into and out of said aperture, said non-motorized element appearing to chase after said motorized element and said motorized element appearing to be propelled by said non-motorized element.

15. A toy as in claim 14, wherein said tether is substantially invisible.

16. A toy as in claim 14, wherein said flexible, non-motorized element is in the shape of an animal and said motorized element is in the shape of a ball.

17. A toy as in claim 14, further comprising a switch for actuating said driving mechanism.

18. A two part toy comprising:

a motorized portion containing a motor;

a non-motorized portion spaced apart from said motorized portion; and a substantially invisible, clear flexible tether having a first end connected to said motorized portion through an aperture in said motorized portion and a second end coupled to an attachment point on a head portion of said non-motorized portion to thereby connect said non-motorized portion to said motorized portion so that the entirety of said non-motorized portion can move freely in three dimensions around the attachment point on said motorized portion and such that a portion of the tether is movable into and out of the aperture;

whereby said non-motorized portion is connected to said motorized portion such that said non-motorized portion appears to chase after and propel said motorized portion when said motor is operating.

19. A toy as in claim 18, wherein said non-motorized portion is in the form of an animate object and said motorized portion is in the form of an inanimate object.

20. A toy as in claim 19, wherein said motorized portion is a ball containing an eccentric motor, said non-motorized portion being attached to said motorized portion to appear to chase after and roll with said ball.

21. A toy comprising:

a motorized portion having a driving mechanism;

a furry element spaced apart from said motorized portion and resembling at least a part of a live animal; and a flexible tether connecting said furry element to said motorized portion, said tether connected to said motorized portion through an aperture in said motorized portion, a portion of said tether is movable into and out of said aperture, and the entirety of said furry element having the ability to move freely in all dimensions about an attachment point on said motorized portion;

whereby when said driving mechanism is activated said furry element moves with said motorized portion to simulate a live animal chasing after and propelling said motorized portion so that said motorized portion appears to be propelled by an animal embodied by said furry element.

22. A toy as in claim 21, wherein said motorized portion is a freely rotatable ball and said furry non-motorized element is at least rotatable about a radius of said ball.

23. A toy as in claim 21, wherein said furry element has a nose and said tether connects said nose of said furry non-motorized element to said motorized portion.

24. A two part toy comprising:

a substantially spherical shell having a smooth exterior surface and an internal cavity;

a driving mechanism within said internal cavity, said driving mechanism adapted to impart an eccentric motion to said shell;

a flexible tether connected to said shell through an aperture in said shell, a portion of said tether movable into and out of said aperture; and a flexible toy connected by a head portion to said tether such that said flexible toy is spaced apart from and freely movable in three dimensions with respect to said shell, said shell having an attachment point for said tether that does not extend beyond the exterior surface of said shell.

25. A two part toy as in claim 24, wherein an aperture is defined in said exterior surface of said shell, said tether extending through the aperture.

26. A two part toy as in claim 24, wherein said tether is flexible with respect to said shell.

27. A toy comprising:

a shell containing a motor for propelling said toy;

a tether extending through an aperture in a surface of said shell, a portion of said tether movable into and out of said aperture; and a furry flexible toy spaced apart from said shell and connected to said shell by said tether such that the entirety of said furry flexible toy moves freely in three dimensions relative to said shell.

28. A toy as in claim 27, wherein said tether is clear such that the connection of said furry flexible toy to said shell is substantially invisible.

29. A toy as in claim 27, wherein said shell is substantially spherical and separable into two portions.

30. A toy as in claim 27, wherein said motor has a counterweight that causes eccentric rotation and propulsion of said toy.

31. A two part toy comprising:

a shell having an internal cavity;

a driving mechanism within said internal cavity;

a flexible toy attached by a head portion to said shell and spaced apart from and movable with respect to said shell; and a tether having a first end connected to said shell through an aperture in said shell and a second end coupled to an attachment point on said flexible toy, a portion of said tether being movable into and out of said aperture, said tether being flexible such that the entirety of said flexible toy is freely movable in three dimensions with respect to said shell.

32. A two part toy as in claim 31, wherein said shell is substantially spherical and said tether is freely rotatable about a radius of said substantially spherical shell.

33. A two part toy as in claim 31, wherein:

said shell is substantially spherical; and said driving mechanism is offset from the center of said shell and rotates about an axis through the center of said shell, thereby causing eccentric rotation and propulsion of said shell.

34. A two part toy as in claim 33, further comprising a counterweight on said driving mechanism.

35. A two part toy as in claim 31, further comprising a switch for actuating said driving mechanism.

36. A two part toy as in claim 31, wherein said shell is separable into two substantially hemispherical shells.

37. A two part toy comprising:

a first part in the form of an inanimate object and having an internal cavity;

a driving mechanism within said internal cavity, said driving mechanism adapted to impart an eccentric motion to said first part;

a second part in the form of an animate object; and a flexible tether coupling a head portion of said second part to said first part, the tether connected to said first part through an aperture in said first part, a portion of the tether movable into and out of said aperture such that the entirety of said second part is spaced apart from and moves freely in three dimensions with respect to said first part.

38. A two part toy as in claim 37, wherein said second part is movable towards and away from said first part.

39. A two part toy as in claim 37, wherein said inanimate object comprises a spherical body.

40. A two part toy as in claim 37, wherein said animate object comprises an animal.

41. A two part toy as in claim 40, wherein said animal has a nose connected to said inanimate object by said tether.

42. A two part toy as in claim 40, wherein said animal is furry.

* * * * *